United States Patent [19]

Ulrich et al.

[11] Patent Number: 4,889,581

[45] Date of Patent: Dec. 26, 1989

[54] CARTON SEALING APPARATUS

[75] Inventors: Lawrence W. Ulrich, Cicero; James R. Lojewski, Oak Park, both of Ill.

[73] Assignee: Durable Pakaging Corporation, Chicago, Ill.

[21] Appl. No.: 272,127

[22] Filed: Nov. 14, 1988

[51] Int. Cl.[4] ..... B32B 31/18

[52] U.S. Cl. ..... 156/443; 156/468; 156/522; 156/552; 53/133; 53/137; 53/412; 242/156.1

[58] Field of Search ..... 156/443, 459, 468, 486, 156/522, 552; 242/55.2, 151, 156.1, 156.2; 226/129, 137, 138, 140, 153, 154, 155, 195; 53/133, 137, 412; 493/963

[56] References Cited

U.S. PATENT DOCUMENTS

| | | | |
|---|---|---|---|
| 524,957 | 8/1894 | Semple | 242/156.1 |
| 2,788,944 | 4/1957 | Krueger | 252/55.2 |
| 4,227,955 | 10/1980 | Woods et al. | 156/522 |
| 4,392,911 | 7/1983 | Ulrich et al. | 156/468 |
| 4,759,819 | 7/1988 | Ingram | 156/522 |
| 4,821,487 | 4/1989 | James et al. | 53/133 |

*Primary Examiner*—Caleb Weston

*Attorney, Agent, or Firm*—Dressler, Goldsmith, Shore, Sutker & Milnamow, Ltd.

[57] ABSTRACT

In an apparatus for sealing the top flaps of a carton having a tape head assembly for applying a strip of self-adhesive sealing tape that extends along the upper portions of the leading and trailing end panels and across the top flaps, a tab forming device for forming a pull tab at a trailing end portion of the strip of sealing tape. The tab forming device includes a housing member having a cavity formed therein in facing relationship to the trailing end portion of the strip of sealing tape. A suction created in the cavity draws the trailing end portion thereinto so as to cause the adhesive surface of the trailing end portion to fold upon itself and form a pull tab. A means for controlling the dispensing of the tape from the roll is provided which includes a spool member which is biased into receiving contact with the outer portion of the roll.

9 Claims, 5 Drawing Sheets

CARTON SEALING APPARATUS

BACKGROUND OF THE INVENTION

The present invention relates generally to apparatus for sealing the foldable flaps of cartons by applying a strip of self-adhesive tape material along the edges of the flaps and, more particularly, to a system for forming a pull tab at one end of the strip of tape as it leaves the tape head, to facilitate removal of the tape to gain access to the interior of the carton, and a mechanism for controlling the tracking of the tape in the tape head.

In the packaging industry, corrugated and fiberboard cartons have been used for many years and various machines have been developed which are capable of sealing such cartons either by glueing the flaps, taping the flaps, or by stapling or otherwise providing fasteners to maintain the flaps in a closed position. Many of these machines are designed to accept cartons of random width and height by providing various types of means to control the transverse movement of the side arm assemblies associated therewith and the vertical movement of the top sealing means. An example of such a machine is disclosed in U.S. Pat. No. 4,392,911, assigned to the same assignee as the present invention.

It is the typical practice to seal the top flaps of a carton by applying a strip of sealing tape that extends along the upper portion of the leading end panel, across the top of the carton in sealing relationship to the edges of the upper major flaps, and then down an upper portion of the trailing end panel. The strip of tape is pressed into sealing contact with the carton end panels and the major side flaps. When it becomes necessary to open such cartons, it is the typical practice to utilize a sharp implement, such as a knife, to slice open the carton. In so doing, the sharp implement may contact the goods in the carton causing damage thereto.

It has heretofore been proposed to form a tab section at one end of the strip of tape, as the carton is being sealed, which facilitates peeling off the tape to gain access to the interior of the carton. The present invention is directed to a simple, reliable, and inexpensive means for automatically forming a pull tab at the trailing end portion of the strip of tape as the carton passes through the taping head of a carton sealing apparatus. The present invention is further directed to an improved means for controlling the tracking of tape in the tape head.

SUMMARY OF THE INVENTION

In accordance with the invention, a tab forming means is provided for forming a pull tab at a trailing end portion of the strip of sealing tape. The tab forming means is positioned adjacent the means for cutting the tape associated with the tape head assembly and includes a housing member defining a cavity formed in facing relationship to the trailing end portion. A suction is created in the cavity for drawing the trailing end portion thereinto so as to cause the adhesive surface thereof to fold upon itself and form a pull tab. A means for controlling the dispensing of the tape from a roll is provided which includes a spool member which is biased into receiving contact with an outer portion of the roll.

DESCRIPTION OF A PREFERRED EMBODIMENT

While this invention is susceptible of embodiment in many different forms, this invention and the accompanying drawings disclose only one specific form as an example of the use of the invention. The invention is not intended to be limited to the embodiment so described, and the scope of the invention will be pointed out in the appended claims.

Some of the figures illustrating the preferred embodiment of the apparatus show structural details and mechanical elements that will be recognized by one skilled in the art. However, the detailed descriptions of some of these elements are not necessary to an understanding of the invention and, accordingly, are not herein presented.

Figure 1:
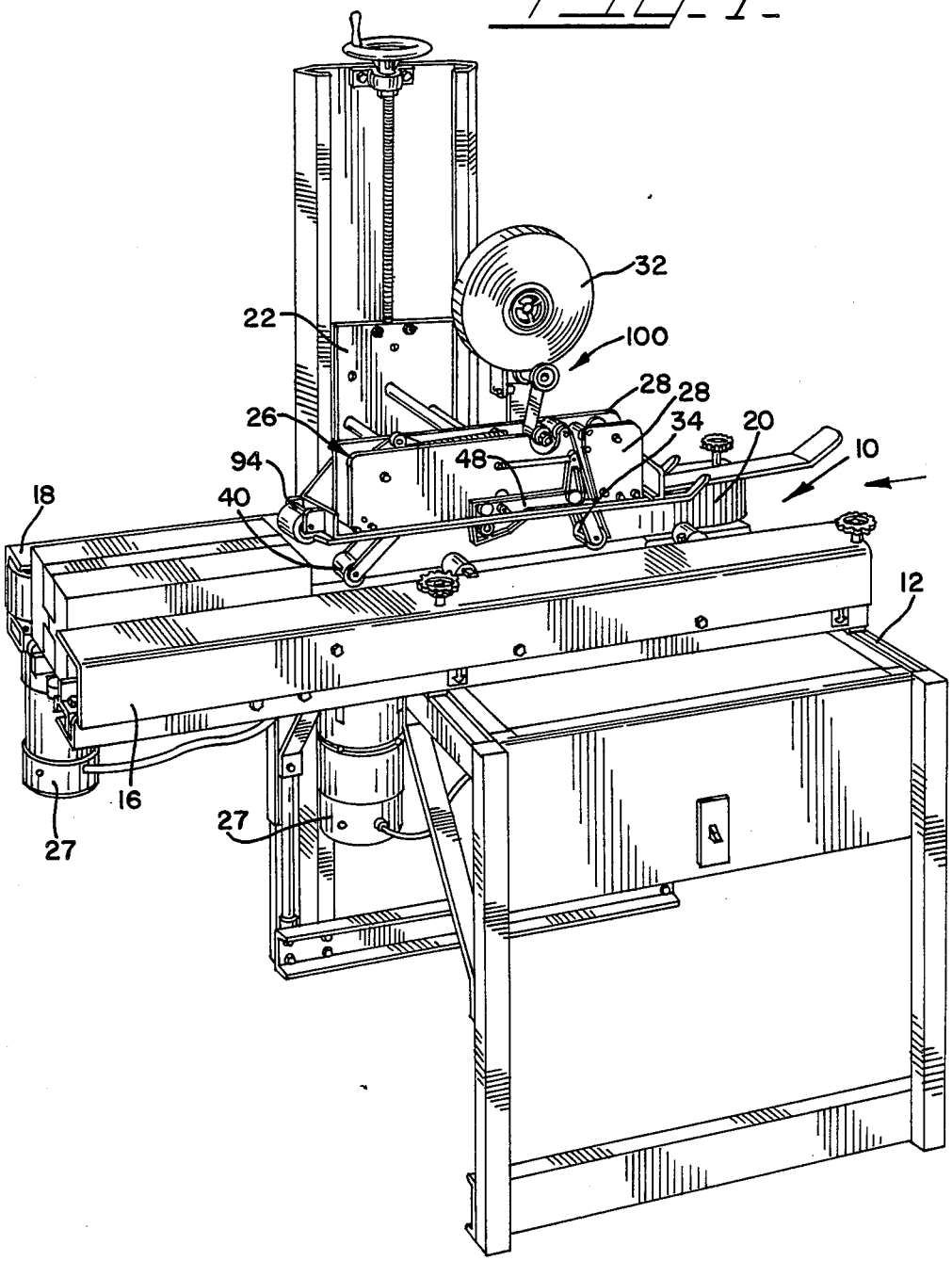
FIG. 1 is a perspective view of a carton sealing machine of the general type which employs the present invention.

Referring now in detail to the drawings, and in particular to FIG. 1, a carton sealing machine is indicated generally at 10. The brief discussion of carton sealing machine 10 that hereinbelow follows is for the purpose of generally disclosing a type of carton sealing apparatus, which the present invention is contemplated for use in conjunction therewith. It should be understood that the teachings of the present invention may be employed in alternative designs of carton sealing machines.

Carton sealing machine 10 includes a frame structure 12. A plurality of transversely spaced carton conveying roller assemblies (not shown) is supported on frame 12. A pair of transversely spaced and longitudinally extending side arm assemblies 16 and 18 is mounted to frame 12 above the rollers. The side arm assemblies 16 and 18 are mounted to frame 12 so as to permit transverse sliding movement towards and away from each other. Endless conveyor belts 20 (one one of which is shown) are journalled for rotation around roller members associated with the side arm assemblies 16 and 18. Extending vertically upward from frame 12 is a lift assembly 22. Lift assembly 22 is secured to a top tape head assembly 26 and is effective to move the tape head assembly up and down above the frame 12. A motor 27 is in communication with one of the rollers (not shown) associated with each of the side arm assemblies 16 and 18 to drive the endless belts 20. Although not specifically illustrated, a bottom tape head assembly may be mounted to frame 12.

Briefly stated, the operation of carton sealing machine 10 is as follows. The elevation of the top tape head assembly 26 is adjusted to accommodate the height of the carton and the spacing between the side arm assemblies 16 and 18 is adjusted to accommodate the width of the carton. The carton is then fed into the entrance end of machine 10, in the direction of the arrow in FIG. 1, until the belts 20 contact the sides of the carton. The belts 20 remain in contact with the carton and move it past the tape head assembly 26 where a strip of sealing tape is applied across the top surfaces of the side flaps and the upper portions of the end walls. The belts 20 continue to move the carton for delivery to an outlet conveyor (not shown) attached to the exit end of machine 10.

Figure 2:
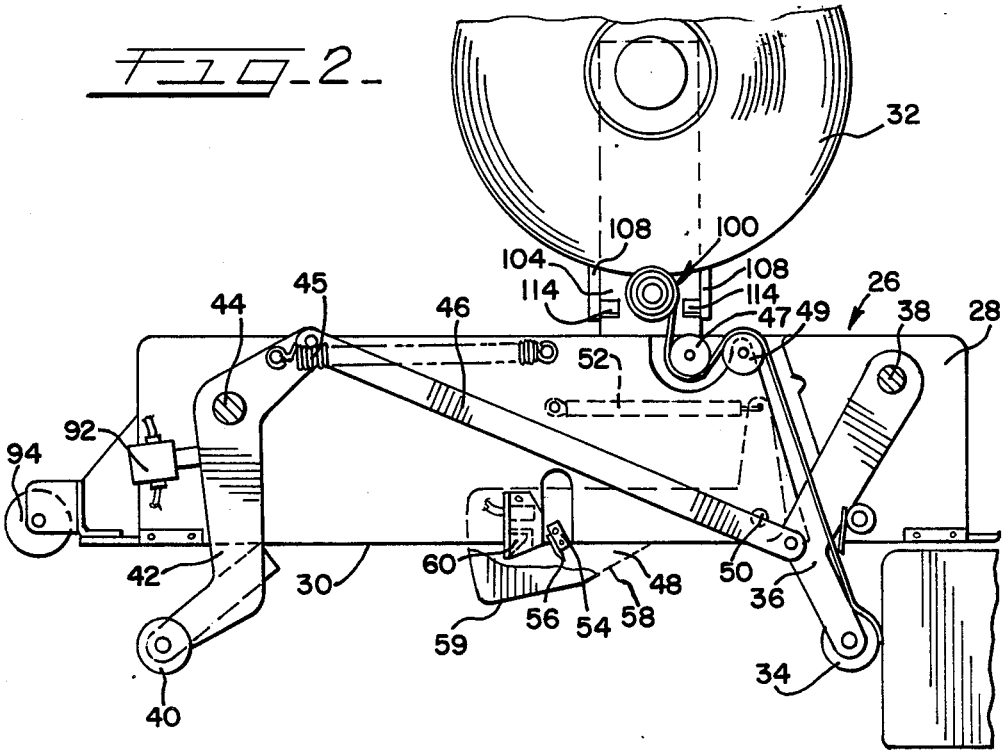
FIGS. 2–5 are schematic side elevational views of a tape head assembly incorporating the present invention sequentially illustrating the application of a strip of tape to seal the top flaps of a carton as it moves through the tape head.

Referring to FIGS. 2–5, a tape head assembly 26 of exemplary construction is schematically shown in sequential stages applying a strip of sealing tape to a carton as it moves through the tape head assembly. Tape head assembly 26 includes a means for receiving a roll of tape 32 having an adhesive surface on one side thereof. Tape head assembly 26 includes side plates 28 having horizontal lower surfaces 30, the elevation of which is adjusted by lift assembly 22 to an elevation at or slightly above the elevation of the leading upper edge of the carton. A leading roller 34 is journalled for rotation about a lead arm 36 mounted for pivotal rotation about pivot 38. A trailing roller 40 is journalled for rotation about a trail arm 42 for pivotal rotation about pivot 44. Arms 36 and 42 are linked by a connecting linkage 46 such that upward movement of leading roller 34 is translated to upward movement of trailing roller 40. A spring member 45 extending between side plate 28 and arm 42 biases arms 36 and 42 towards their lower positions, as shown in FIG. 2. A portion of the tape is directed around rollers 47 and 49 and extends adjacent roller 34, with the adhesive side thereof facing away from the roller.

Figure 3:
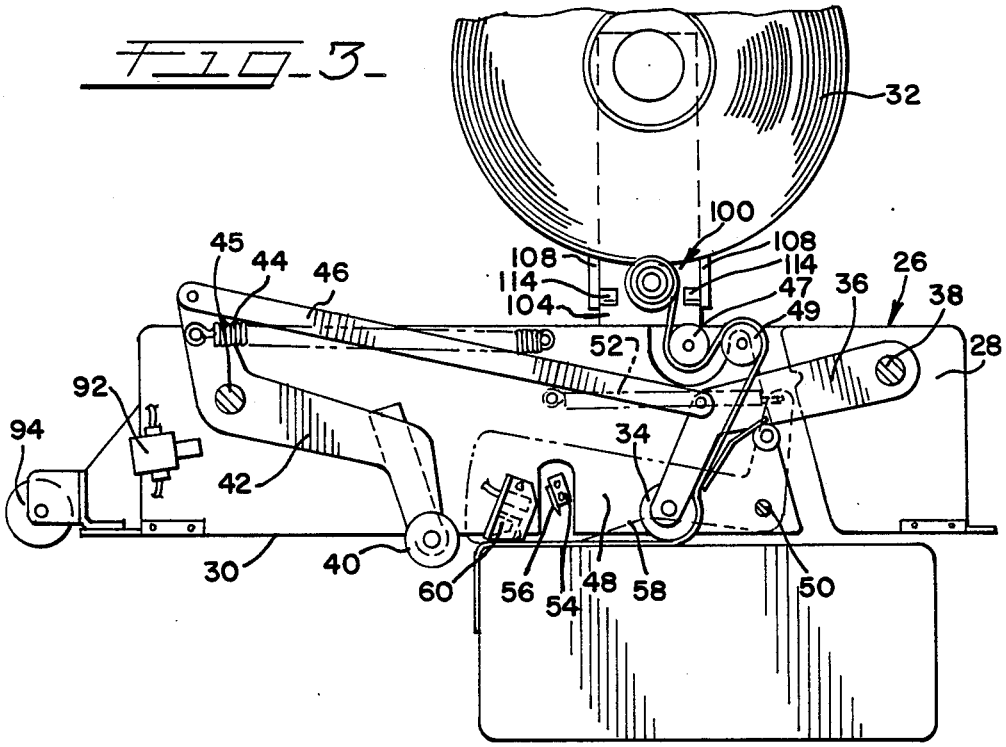

A cutoff arm 48 is pivotally mounted to side plate 28 about pivot 50 and is movable between a lowered position, as shown in FIG. 2, and a raised position, as shown in FIG. 3. A spring member 52 extending between side plate 28 and arm 48 biases arm 48 towards its lowered position. A cutoff blade assembly 54, having a downwardly extending cutoff blade 56, is mounted to arm 48 and is movable therewith. Blade assembly 54 is positioned relative to the lower edge of side plate 28 such that when side plate 28 is in its lowered position, blade 56 extends downwardly below the elevation of surface 30 of side plate 28, as shown in FIG. 2, and when side plate 28 is in its raised position, blade 56 is positioned above the elevation of surface 30 of side plate 28, as shown in FIG. 3. Cutoff arm 48 is provided with guide surfaces 58 and 59, which when contacted by the leading edge of a carton, move arm 48 from its lowered position to its raised position against the bias of spring member 52.

Referring to FIGS. 2–5, a tab forming device 60 is pivotally secured to tape head assembly 26. Referring to FIGS. 6–11, tab forming device 60, constructed in accordance with a preferred embodiment of the present invention, comprises a housing member 62, a back plate member 64, and a block member 66. Block member 66 is attached to a lower portion of the inner surface of back plate member 64 by screws 68. Back plate member 64 is attached to housing member 62 by screws 70.

Figure 10:
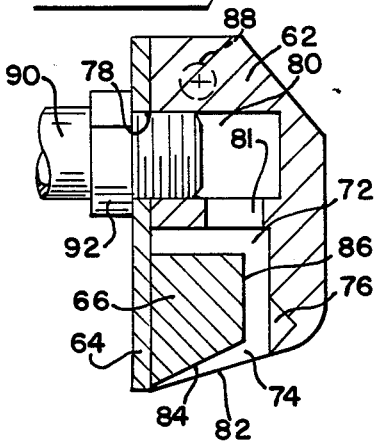
FIG. 10 is a sectional view taken along line 10—10 in FIG. 6.

Housing member 62 has a cavity 72 formed therein into which block member 66 extends so as to define an elongated opening 74 adjacent the lower surface thereof. Opening 74 communicates with an elongated concave recess 76 formed in the front wall of housing member 62, as best seen in FIG. 10. A substantially horizontal opening 78 extends through plate 64 in alignment with a threaded cavity 80 formed in housing member 62. A passage 81 is formed in housing member 62 through which cavity 80 communicates with cavity 72. Bottom guide surfaces 82 of member 62 slope downwardly from their front edge toward their rear edge. As best seen in FIG. 10, a bottom surface 84 of block member 66 slopes downwardly from its front edge towards its rear edge at a greater slope than surfaces 82 so as to define a surface that inclines towards recess 76. A forward surface 86 of block member 66 is substantially parallel to the front wall of housing member 62 and is spaced therefrom.

Tab forming device 60 is pivotally mounted to tape head assembly 26 in a suitable manner such as by pivot pins (not shown) extending into openings 88 formed in housing member 62. Referring to FIG. 2, device 60 is gravitationally biased into a first position such that the forward edges of surfaces 82 thereof are approximately at the elevation of surfaces 30 of side plates 28, and the rearward edge of surface 82 extends below surfaces 30 of side plates 28. Referring to FIG. 10, a first end of a conduit 90 is secured to member 60 through a suitable fitting 92 which extends through opening 78 into cavity 80, and the other end thereof communicates with a suitable vacuum source (not shown). Referring to FIG. 2, the vacuum in conduit 90 is controlled by a switch 92 such that when arm 42 is in contact with switch 92 the vacuum source is off, and when arm 42 is not in contact with switch 92, the vacuum source is on and creates a vacuum in conduit 90.

Referring to FIGS. 1–5, the benefits of the present invention will become apparent from the following discussion of the operation of carton sealing machine 10. The elevation of the tape head assembly 26 is adjusted to accommodate the height of the carton, and the spacing between the side arm assemblies 16 and 18 is adjusted to accommodate the width of the carton. The carton is then fed into the entrance end of the machine 10, in the direction of the arrow in FIG. 1, until the belts 20 contact the sides of the carton. Belts 20 move the carton into contact with leading roller 34 so that the adhesive side of a leading end portion of the tape 32 adjacent roller 34 contacts the leading end panel of the carton, as shown in FIG. 2. As the carton is fed through the machine, arm 36 is pivotted upward as the tape is applied up the leading end panel and across the upper major side flaps of the carton by roller 34, as shown in FIG. 3. As the upper edge of the end panel contacts surfaces 58 and 59 of cutoff arm 48, it is moved into its raised position against the bias of spring member 52. As the upper edge of the end panel contacts surface 82 of tab forming device 60, it is pivotted towards its second or tab forming position. Simultaneously with the upward movement of arm 36 to its raised position, arm 42 is moved into its raised position breaking contact with switch 92 causing a vacuum in tube 90 and cavity 72 of tab forming member 60.

Figure 4:
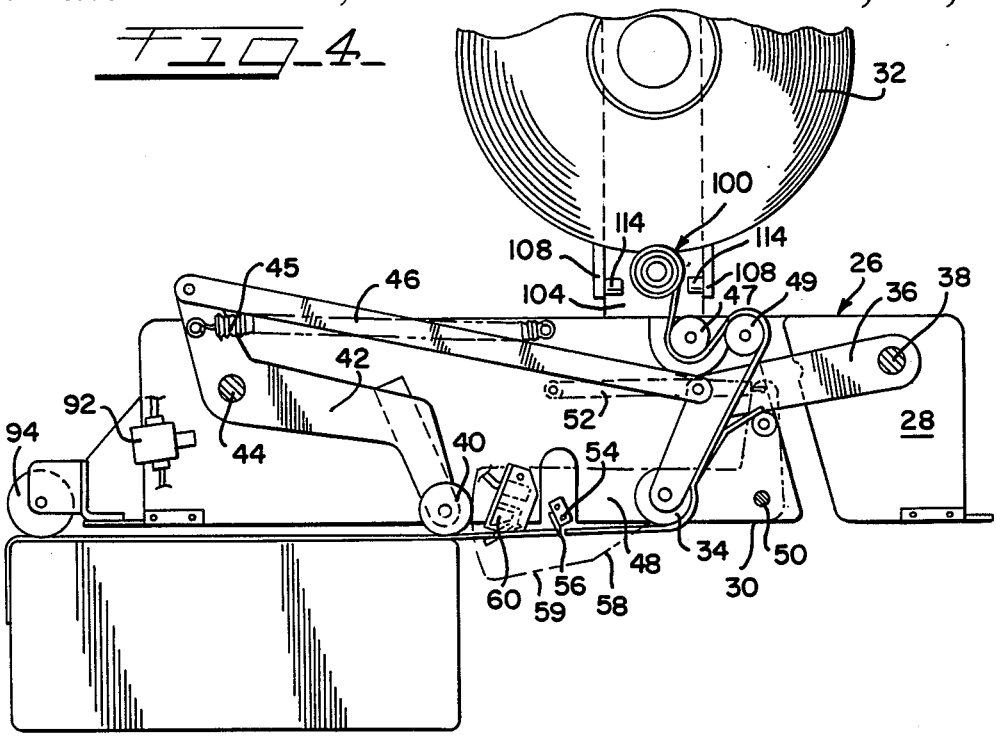
Figure 11:
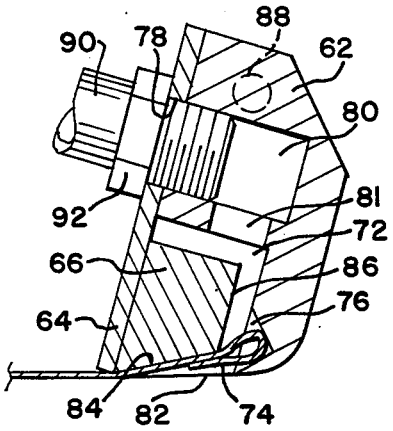
FIG. 11 is a sectional view similar to FIG. 10 showing the tape tab forming device in its pivotted position forming a tab at the trailing end portion of a strip of tape.
Figure 13:
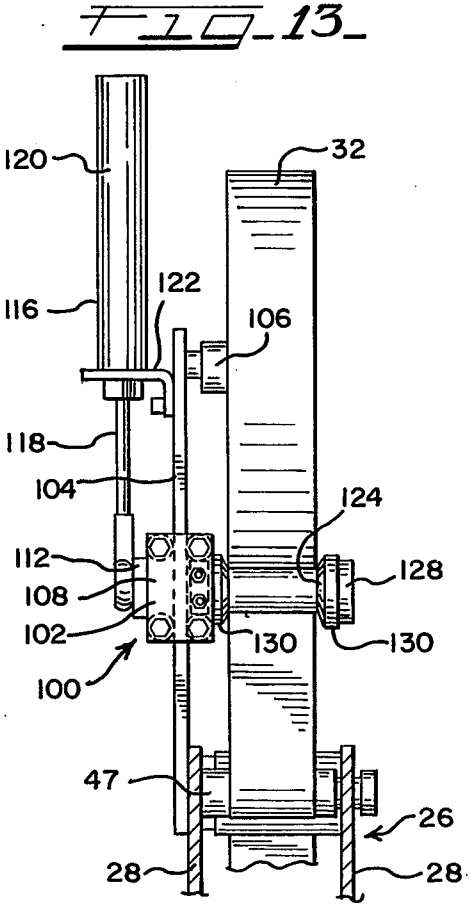
FIG. 13 is a side elevational view taken along line 13—13 in FIG. 12.
Figure 12:
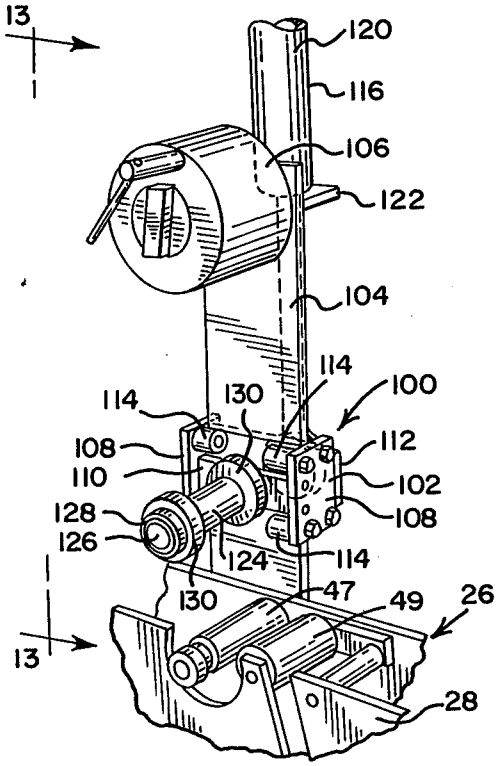
FIG. 12 is a perspective view of the mechanism for controlling of the tracking of the tape constructed in accordance with the present invention, with the roll of tape removed therefrom.

Referring to FIG. 4, as the carton continues through the machine, the tape is extended across the entire length of the carton and wiped down by roller 40. When the upper edge of the trailing end panel of the carton moves past the rearward edge of surface 59 of cutoff arm 48, cutoff arm 48 snaps back to its lowered position causing blade 56 to cut the tape, leaving a substantially horizontally extending portion thereof between the blade and the trailing edge of the carton. Referring to FIG. 11, the suction in cavity 72 causes the trailing end portion of the tape to be drawn upwardly into elongated opening 74 of device 60 into contact with surface 84 so as to cause the adhesive surfaces thereof to fold upon itself in recess 76 and form a pull tab.

Figure 5:
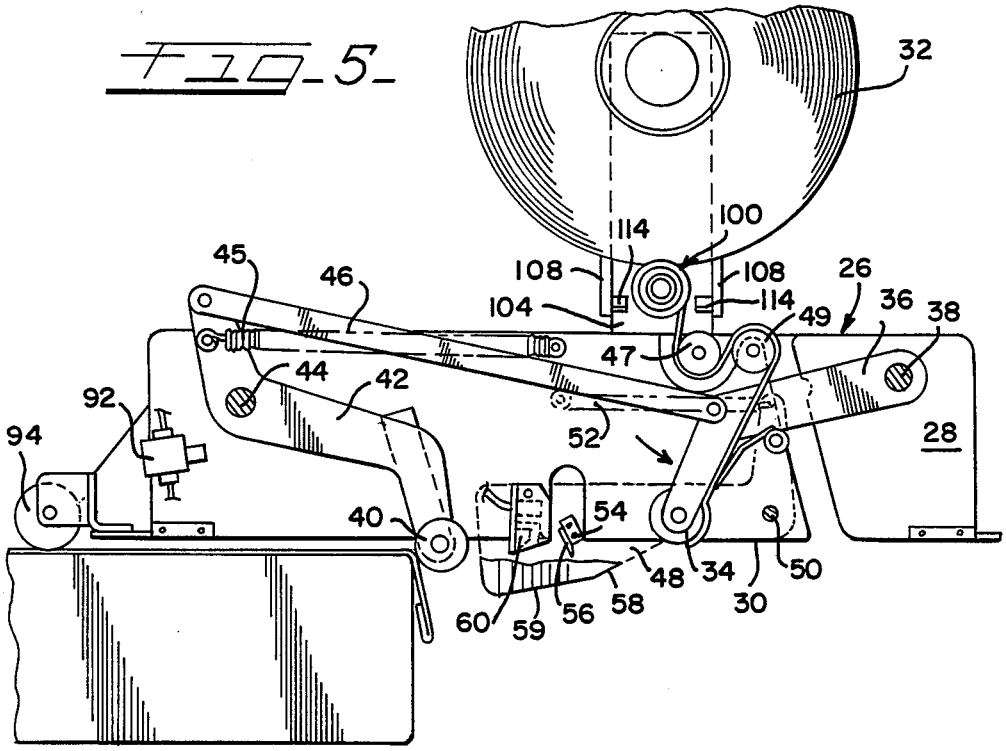
Figure 6:
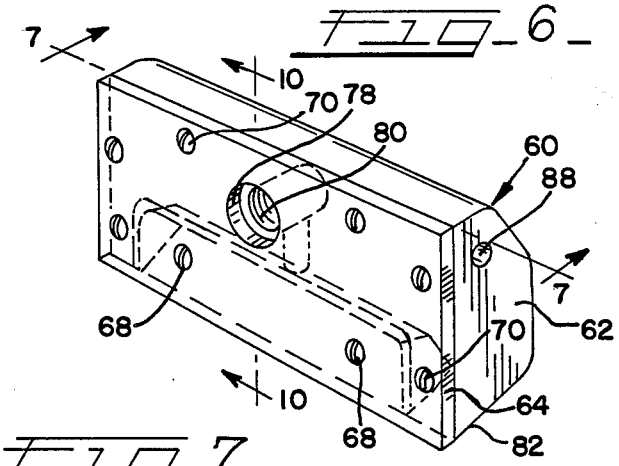
FIG. 6 is a perspective view of the tape tab forming device constructed in accordance with a preferred embodiment of the invention.
Figure 7:
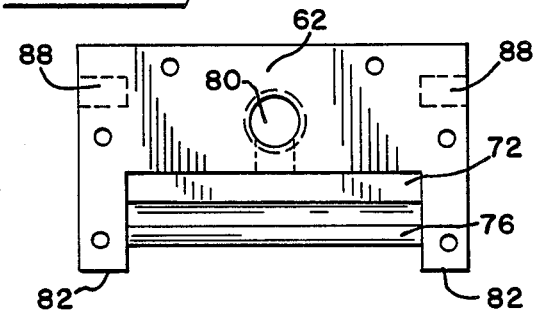
FIG. 7 is a front elevational view taken along line 7—7 in FIG. 6 of the housing member portion of the tape tab forming device.
Figure 8:
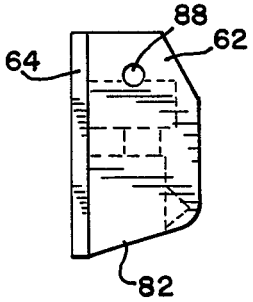
FIG. 8 is a side elevational view of the tape tab forming device shown in FIG. 6.
Figure 9:
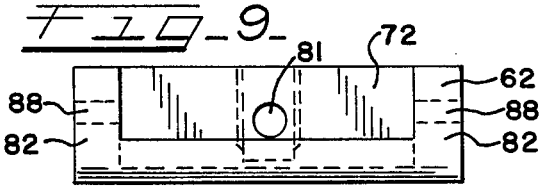
FIG. 9 is a bottom plan view of the housing member shown in FIG. 7.

Referring to FIG. 5, as the upper trailing edge of the carton moves past roller 40, arms 36 and 42 are caused to return to their lowered positions by spring member 45 which, in turn, causes roller 40 to wipe the tape to be trailing end panel of the carton with the pull tab not adhesively secured thereto. A supplemental roller 94 may be provided to tape head assembly 26 to further wipe the tape across the top of the carton prior to exiting the machine.

It will be readily apparent that, when it is desirable to remove the tape from the carton to gain access thereto, the tape tab is grasped and the tape may be peeled off the carton, permitting the top flaps to be unfolded.

Referring to FIGS. 1, 2–6, 12 and 13, in accordance with a preferred embodiment of the invention, an improved mechanism for controlling the tracking of the tape dispensed from roll 32 is indicated at 100. Mechanism 100 includes a carriage assembly 102 which is slidably mounted to a support arm 104 which receives roll 32 about cam lock core holder assembly 106 attached thereto. Carriage assembly 102 includes a pair of spaced-apart end plates 108 connected together by side plates 110 and 112 positioned on opposite sides of arm 104. End plates 108 have rollers 114 extending inwardly therefrom in contact with the front and rear surfaces of arm 104 so as to permit vertical movement of carriage assembly 102 with respect to arm 104. In accordance with a preferred embodiment, the vertical movement of carriage assembly 102 is controlled by a pneumatic cylinder 116 having a piston 118 suitably secured to plate 112 and a cylinder 120 secured to arm 102 through a bracket 122.

A spool member 124 is journaled for rotation about an axle 126 extending outward from plate 110 and is secured in place by a lock ring 128. Spool member 124 is formed with a pair of outwardly extending rims 130 which are spaced apart a distance slightly greater than the width of the tape on roll 32. An outer portion of roll 32 is received between rims 130 in contact with spool member 124. Cylinder 116 upwardly biases carriage assembly 102 such that spool member 124 is continuously biased into receiving contact with roll 32 as its diameter is reduced during operation of the tape head assembly. In so doing, spool member 124 improves the tracking of the tape through the tape head assembly by precluding the outer portion of the roll from wobbling with respect to assembly 106 and by providing a small resistance to the rotation of the roll.

The present invention contemplates the use of alternative means to upwardly bias carriage assembly 102 such as, for example, a spring extending between the carriage assembly and bracket 122.

Various modifications are contemplated and may obviously be resorted to by those skilled in the art without departing from the spirit and scope of the invention, as hereinafter defined by the appended claims, as only a preferred embodiment has been disclosed.

What is claimed is:

1. In an apparatus for sealing the top flaps of a carton directed therethrough, said apparatus having a tape head assembly for applying a strip of self-adhesive sealing tape that extends along the upper portions of the leading and trailing end panels and across said top flaps in sealing relationship thereto, said tape head assembly including cutting means for cutting the strip of sealing tape at the trailing end thereof and tab forming means for forming a pull tab at a trailing end portion of said strip of sealing tape, said tab forming means including a housing member positioned a short distance from said cutting means having a cavity formed therein in facing relationship to said trailing end portion, and means for creating a suction in said cavity for drawing said trailing end portion thereinto so as to cause the adhesive surface of said trailing end portion to fold upon itself and form a pull tab.

2. The invention as defined in claim 1 wherein said housing member is pivotally mounted to said tape head assembly about a substantially horizontal axis a short distance rearwardly of said cutting means and has inclined guide surfaces which extend a short distance therebelow so as to contact the leading edge of a carton directed thereagainst to pivot said housing member into a predetermined tab forming position.

3. The invention as defined in claim 2 wherein said cavity has an elongated opening at a lower portion thereof for receipt of said trailing end portion thereinto, a block member is positioned in said cavity and defines a surface extending into said lower portion of said cavity against which a section of the strip of sealing tape rests against as said pull tab is formed.

4. The invention as defined in claim 3 wherein said lower portion of said cavity defines a concave recess spaced from said block member into which a fold portion of said pull tab extends so as to cause the adhesive surface of said trailing end portion to fold upon itself.

5. The invention as defined in claim 4 wherein said cavity is in communication with said means for creating a suction through a second cavity formed in an upper portion of said housing member.

6. The invention as defined in claim 4 wherein said surface defined by said block member is inclined at a greater angle than said guide surfaces positioned on either side thereof so as to define said elongated opening between said guide surfaces.

7. The invention as defined in claim 6 wherein said concave recess is positioned adjacent said elongated opening in facing relationship with the forward edge of said surface defined by said block member.

8. The invention as defined in claim 7 further including a back plate member secured to said housing member in covering relationship thereto, said block member being secured to said back plate member.

9. The invention as defined in claim 1 wherein said tape head assembly includes means for rotatably supporting a roll of sealing tape about a substantially horizontal axis, said tape head assembly having means for controlling the dispensing from said roll of tape including a spool member mounted thereto which is biased into receiving contact with an outer portion of said roll of tape.

* * * * *